US005885940A

United States Patent [19]

Sumimoto

[11] Patent Number: 5,885,940

[45] Date of Patent: Mar. 23, 1999

[54] METHOD OF SUPPLYING AND TREATING LUBRICANT OIL IN GAS SERVICE STATION

[75] Inventor: Morio Sumimoto, Yokohama, Japan

[73] Assignee: Glen R. Premru, Scottsdale, Ariz.

[21] Appl. No.: 839,776

[22] Filed: Apr. 15, 1997

[30] Foreign Application Priority Data

Apr. 16, 1996 [JP] Japan ..... 8-118360

[51] Int. Cl.[6] ..... C10M 177/00; C10M 175/00

[52] U.S. Cl. ..... 508/111

[58] Field of Search ..... 508/111

[56] References Cited

U.S. PATENT DOCUMENTS

| | | | |
|---|---|---|---|
| 3,127,255 | 3/1964 | Winslow | 508/111 |
| 3,450,627 | 6/1969 | Johnson | 508/111 |
| 4,264,436 | 4/1981 | Shim | 508/111 |
| 4,435,287 | 3/1984 | Sumimoto . | |
| 4,492,636 | 1/1985 | Burke | 508/111 |
| 4,597,882 | 7/1986 | Nishimura et al. | 508/111 |
| 4,789,460 | 12/1988 | Tabler et al. | 508/111 |

*Primary Examiner*—Jerry D. Johnson
*Attorney, Agent, or Firm*—Ronald R. Snider

[57] ABSTRACT

The total or a partial quantity of lubricant oil for automotive vehicles is exchanged at a gas service station when a vehicle visits for its fuel supply. The lubricant oil is maintained with low values of contaminates, while extracted waste oil is purified and supplemented with lacking additive agents for reuse as fresh lubricant oil. An impurities removal equipment has a centrifuge and a filter device for the purification.

8 Claims, 5 Drawing Sheets

METHOD OF SUPPLYING AND TREATING LUBRICANT OIL IN GAS SERVICE STATION

RELATED APPLICATIONS

This present disclosure relates to subject matter contained in Japanese Patent Application No. 8-118360 (filed on Apr. 16, 1996) which is expressly incorporated herein by reference in its entirety.

BACKGROUND OF THE INVENTION

This invention relates to a system used in a gas service station, where lubricant oil is extracted from automotive vehicles after use for proper treatment when they visit the gas service station for fuel refilling.

According to the statistics announced by Californian Authorities in 1988, annual consumption of the lubricant oil throughout U.S.A. was eight million tons, and it is now deemed that 57% of the above consumed oil has been abandoned. It is now feared that one-fourth of the above 57% might have been illegally abandoned. After formal and legal collection by treatment factories, only a part of the used oil is treated into diesel engine oil for reuse while remaining large part is used as fuel for burning. When this fuel is burned, calcium, barium and other additives which are included in the lubricant oil produce poisonous chemical compounds during burning, and such compounds are emitted in the air to contaminate the atmosphere. The consumed oil which is illegally and directly abandoned to the ground causes earth contamination. When the treated oil is used for diesel engine fuel, there is a bad influence on the engine which causes some engine trouble.

There are three factors which change the lubricant oil into waste material:

1. Mixture of increased amount of impurities such as combustion remnants, incombustibles, water, gasoline, and metal dust.
2. Deterioration and wear of additive agents.
3. Deterioration of oil itself by oxidization.

According to the knowledge of the present inventor, about 90% of the change is caused by the mixture of the increased amount of impurities, and approximately 10% is caused by the deterioration and wear of additive agents, while the oil deterioration is not significant. Therefore, a large amount of the waste oil can be recycled as clean lubricant oil when the impurities are removed and additive agents are supplemented therein.

The lubricant oils which are presently used in automotive vehicles are high quality, and therefore the vehicles can be driven up to 100,000 kilo meters without exchanging the oil. The main object of oil exchange is to maintain good fuel consumption and to maintain compression braking ability. Lubricant oils where impurities are increased and additive agents are worn produce lower engine output and bad fuel consumption. At the same time, the solid impurities collect on the outlet valve seats and damage the sealing ability of the valves. This also reduces engine braking and engine efficiency during running. In order to avoid these situations, oil exchange is required after a proper running time period or a running distance.

In general, the oil exchange is now performed for all of the oil in an engine at one time in a gas service station or repairing factory after 3000~5000 kilo meters driving. However, this exchange system is not preferable because the degree of the contamination of the oil is very different between the initial time and the final time.

SUMMARY OF THE INVENTION

This invention has an object to provide a method, wherein the total amount or a partial quantity of lubricant oil in an automotive vehicle is exchanged at a gas service station whenever the vehicle visits there for their fuel resupply. In this way the lubricant oil is maintained low in contamination values while extracted and waste oil is purified and additive agents are supplemented therein. The oil is then reused as a fresh lubricant oil for the next vehicle. No lubricant oil is abandoned outside as waste material.

The present invention has another object to provide a method, wherein the oil to be abandoned is reused as exchange oil. This diminishes the demand for fresh lubricant oil and benefits energy econmization.

The invention has a further object to provide a method to decrease waste oil which is illegally abandoned onto the earth. This prevents earth contamination.

This invention has a further object for provision of a method, wherein combustion efficiency of the engine is greatly improved without emitting incombustible impurities in the air. Still further engine braking is maintained constant.

In order to accomplish these objects, this invention has adopted following means: when the vehicle visits a gas service station for its fuel supply, at least a partial quantity of its used lubricant oil is extracted, and at the same time or immediately after this extraction fresh oil in an exactly same quantity as the extracted oil is refilled into the engine. The extracted oil is then purified and stored in the station by use of impurities removal equipment while lacking additive agents are supplemented therein. The oil is then available for reuse as the fresh lubricant at the next succeeding exchange opportunity. The impurities removal equipment is composed of a centrifuge and a filter device. The centrifuge is to remove impurities larger than 10 $\mu$m while a filter device which is equipped with filter elements constituted of piled thin papers removes impurities bigger than 1 $\mu$m. Thus, the exchange of the lubricant oil in the vehicle is periodically performed in a short time, such as each time it is refueled.

This invention is characterized in that coaxial pump is used to extract the waste oil from and to refill the fresh oil into an engine simultaneously.

It is also characterized that the vehicle engine is equipped with an oil gauge pipe and oil extraction is performed via the oil gauge pipe.

It is further characterized that an extracting pipe is connected with a drain hole of an oil pan equipped with an engine for free use. However, the pipe is tightly sealed until the exchange of the oil is performed.

It is further characterized that oil pressure during engine operation conveys waste oil into a pressure container built in the station for storing waste oil while fresh oil stored in the container is to be simultaneously conveyed into the engine.

DESCRIPTION OF THE PREFERRED EMBODIMENT

Figure 1:
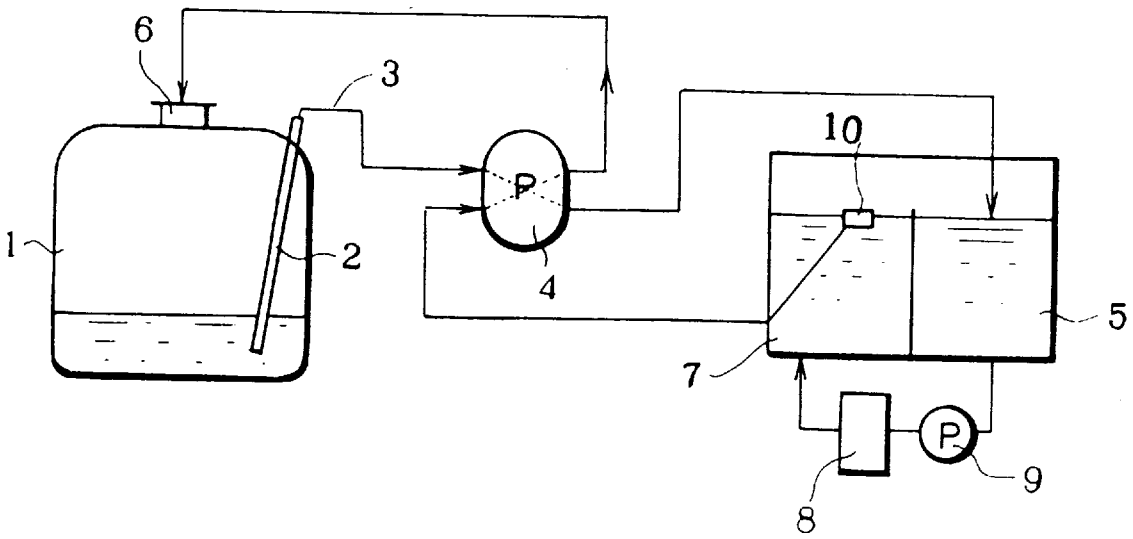
FIG. 1 is a circuit diagram showing an embodiment of an Example 1.

Preferred embodiments of this invention are now described.

This invention provides a method of exchanging lubricant oil stored in a gas service station, where a total or partial quantity of the lubricant oil is extracted from an automotive vehicle and the same quantity of fresh lubricant oil is refilled when the vehicle visits a station for its fuel supply. Accordingly, the oil exchange is performed in a very short time. A cycle period of the oil exchange is now the same as the time whenever the vehicle comes to the station having a stand for its fuel supply. Thus, the lubricant oil which is stored in an engine is changed by fresh oil at approximately 200~500 kilo meters run for the vehicle. The exchange of the lubricant oil in a short time run promotes good maintenance conditions for the engine because the lubricant oil in the engine is not badly contaminated. On the other hand, the extracted oil is purified for reuse in the stand.

The quantity of the exchange is in general the total quantity of the lubricant oil stored in the engine, but a partial quantity may also be exchanged depending on circumstances such as fuel refilling time or exchange efficiency. In the case of a partial quantity, it is preferable to exchange at least a half of the total quantity at one time. It is now recommended as an optimum method, that the waste oil be extracted from a lower part of the engine while the fresh oil is refilled from an upper side within the fuel supplying time of the vehicle such as 5 to 10 minutes.

The used oil which is extracted from the engine is conveyed to a storing tank, where the impurities included in the oil are removed by impurities removal equipment and then the oil is stored at a fresh oil tank. Required additive agents are supplied into the purified oil for the next exchange. Like this, lubricant oil which is extracted from the vehicle is recycled for the same use without abandonment. Therefore, it is not necessary to reuse extracted oil as burning fuel or fuel for diesel engine vehicles.

Lubricant oil extracted from a diesel engine vehicle has slightly different additive agents from that of a normal gasoline vehicle, and therefore the exchange is preferably performed by a separate system.

In the case of purifying treatment for the waste lubricant oil, in the first place impurities bigger in size than 10 $\mu$m are removed by a centrifuge, and next impurities bigger in size than 1 $\mu$m are removed by a filter element which is composed of piled thin papers like tissue papers. By use of this filter element, impurities included in the oil are caught and removed by paper fibers in accordance with the theory of Brownian movement and that of Molecular Attraction. As surface area of the piled thin papers is very large, the removal force is strong. At the same time, because bigger impurities are already removed by the centrifuge, the filtering removal efficiency is very high with inferior blinding.

In order to confirm the filtering forces of the present filter element, the inventor made the following experiment. One piece of this filter element was burned out before use and had an ash weight of 20 grams. On the other hand, a diesel engine was operated for 3,000 hours equipped with the filter element. After this operation, the filter element was also burned out, and as a result the weight of the ash obtained thereof was 210 grams. This experiment shows total 190 grams of impurities were trapped and separated with this filter. In the actual embodiments explained hereafter, 6 pieces of the filter element were assembled into one set, and 4 sets were used with a filter device. Accordingly, impurities totaling 4,560 grams can be removed in theory according to the calculation, 190 grams×6 pcs×4 sets. Thus, this filter device prevents increasing of the impurities in the lubricant oil.

Referring now in details to the drawings, the preferred embodiments are now explained with following four (4) examples.

EXAMPLE 1

With reference to FIG. 1, an extracting pipe (3) is inserted into an oil gauge pipe (2) of an engine (1) of a vehicle when it visits to a gas service station for fuel supply. The pipe (3) is also connected with an oil storing tank (5) installed in the stand via a pump (4). At the same time, an oil supply mouth (6) of the engine (1) is connected with a fresh oil reserve tank (7) via the same pump (4). When this pump (4) is driven, it extracts used lubricant oil from the engine (1) via the oil gauge pipe (2) and it also supplies fresh oil into the engine (1) via the oil mouth (6) in the same quantity as extracted. In this example, the pump (4) is adopted as a coaxial type and it has the force to drive 10 liters per minute. When the pump (4) is operated for one minute for the engine containing 4 liters of oil, this coaxial pump (4) circulates 10 liters of the oil in its passage, and therefore one operation performs two times and a half replacements for 4 liters of oil in the engine. During this operation time, the engine may be stopped. However, if the operation is performed with the engine running, the replacing procedure of lubricant oil promotes to clean inside of the engine so that a flushing effect in the engine can be also obtained.

The extracted oil enters into the storing tank (5) and it was conveyed to the reserve tank (7) via impurities removal equipment (8) by a pump (9) force. The impurities removal equipment (8) comprises a centrifuge which separates impurities in size bigger than 10 $\mu$m and a filter device which is composed of filter elements equipped with piled thin papers and which can remove impurities in size bigger than 1 $\mu$m, whereby impurities in size bigger than 1 $\mu$m included in the oil can be removed. Required additive agents are put into the purified oil for reuse, and this oil is stored in the reserve tank (7). Supernatant fresh oil liquid reserved in the tank (7) is extracted by a float suction (10) and is conveyed to the engine (1) via the pump (4).

EXAMPLE 2

Figure 2:
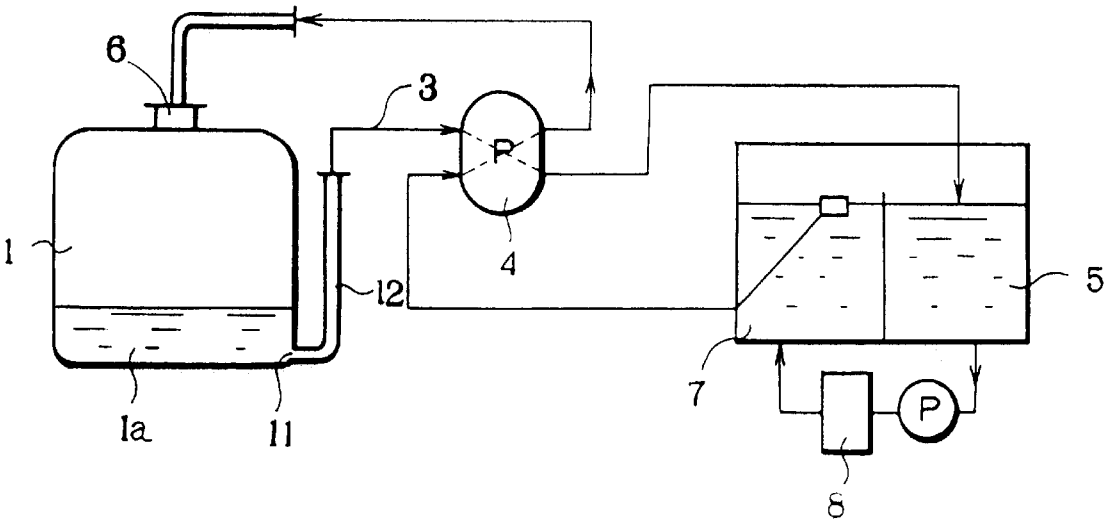
FIG. 2 is a circuit diagram showing an embodiment of an Example 2.
Figure 3:
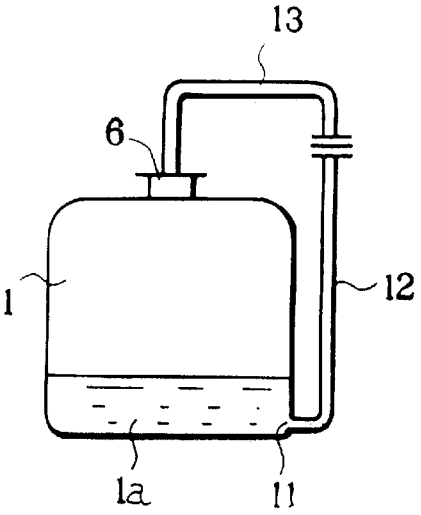
FIG. 3 is a circuit diagram where the car side constitution is shown in case of the Example 2.

FIG. 2 and FIG. 3 show an exchange method of the lubricant oil for a large vehicle equipped with a diesel engine which carries a quantity of the oil from about 30 liters to 40 liters. For large vehicles, the method explained in Example 1 is not proper, because it takes very long time to perform the exchange. As shown in FIG. 2, an exchange pipe (12) with a large diameter is connected with a drain hole (11) of an oil pan **(1*a*) in the engine (1), and this pipe (12) is also connected with an extracting pipe (3), and then a coaxial pump (4) is driven to extract used oil in the oil pan (1*a*). At the same time by the same pump (4) operation, fresh oil in the same quantity of the extracted oil is supplied into the engine (1) through a supply mouth (6)**.

As shown in FIG. 3, the exchange pipe (12) is jointed with the supply mouth (6) by a joint pipe (13) in case of non performance of lubricant oil exchange. When normal gasoline vehicles exchange of their lubricant oil, the quantity of their oil is so small that the exchange of the oil may be possible during the time of fuel supply, but it is preferable to adopt the method of this Example 2 in case of the large vehicles equipped with the diesel engines because they have a large oil capacity. In order to utilize the present method, the exchange pipe (12) is connected with the drain hole (11) of the oil pan **(1*a*), while the pipe (13) is jointed with the supply mouth (6)**.

EXAMPLE 3

Figure 4:
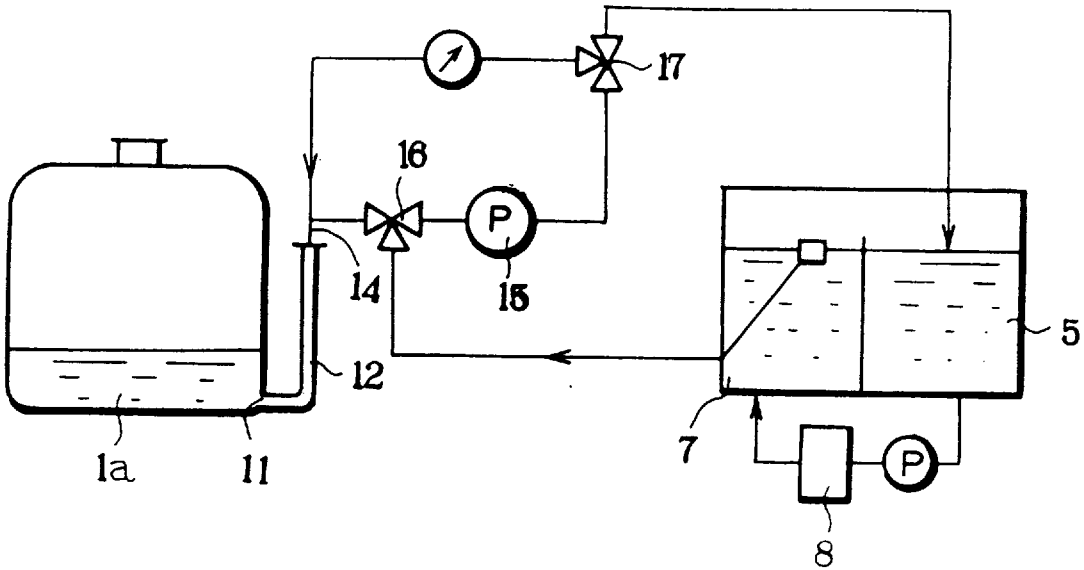
FIG. 4 is a circuit diagram showing an embodiment of an Example 3.

This example is a transformed embodiment of said Example 2. Referring to FIG. 4, an exchange pipe (12) which connects with a drain hole (11) of an oil pan **(1*a*) is tightly sealed with a plug until the exchange of lubricant oil is started. When the exchange is performed, the plug is removed and the exchange pipe (12) is connected with an oil pipe (14), and a pump (15) is driven. The pump (15) is not a coaxial type. In the first step, used oil in the oil pan (1*a*) is extracted, and then fresh oil is supplied by operating two switching valves (16)(17)** respectively.

EXAMPLE 4

Figure 5:
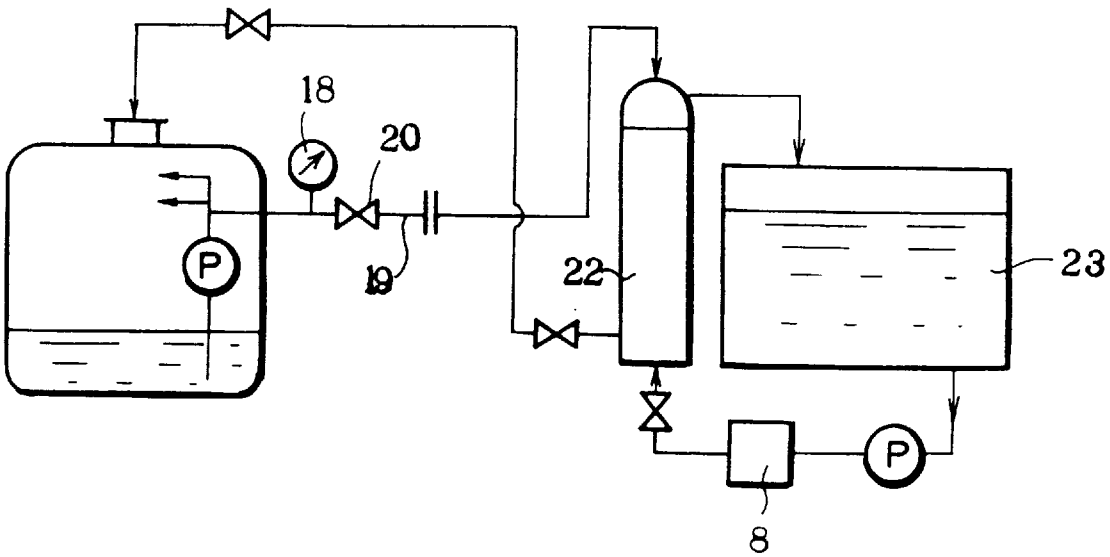
FIG. 5 is a circuit diagram showing an embodiment of an Example 4.

This example shows another embodiment, wherein engine oil pressure force during engine rotation is adopted in stead of a separate pump. Referring now to FIG. 5, a bypass pipe (19) is connected toward one side equipped with an oil pressure gauge (18), and the cock (20) is kept closed until the exchange of lubricant oil is started. When exchange is performed, the bypass (19) is connected by a coupler with a pressure container (22) which contains fresh oil. The container (22) is simultaneously connected with an oil supply mouth (6) of the engine. The oil pressure force caused by the engine rotation conveys used lubricant oil to the container (22) while fresh oil contained in the container (22) is forced out into the engine through the supply mouth (6). In other words, waste oil in the engine is exchanged into fresh oil contained in the container (22). The capacity of the pressure container (22) is from about 50 liters to 100 liters. When the exchange is finished, the used oil in the container (22) is conveyed to a fresh oil tank (23), whereby the waste oil is purified by impurities removal equipment (8) and thus it enters into the container (22) as fresh oil.

Figure 6:
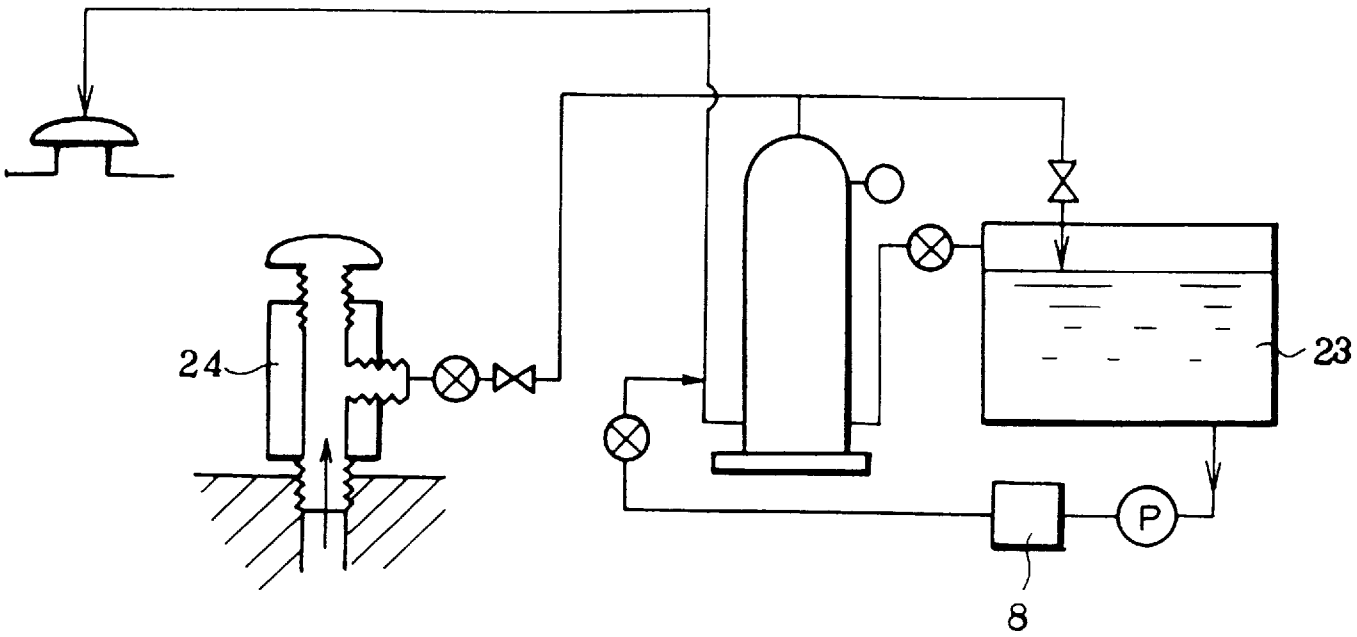
FIG. 6 is a circuit diagram showing a transformed embodiment of the Example 4.

According to FIG. 6, a transformed embodiment of this Example 4 is shown, wherein a coupler device (24) is pre-arranged on a body block of engine itself.

In accordance with this instant invention, the exchange of lubricant oil can be performed easily, and at the same time the extracted oil can be changed into normal lubricant oil for reuse, whereas it is not necessary to make special treatment for extracted oil as abandoned oil, which has been adopted so far. Automotive vehicles can exchange their lubricant oil whenever they visit to a gas service station for their fuel supply. Thus, purity of the oil in the engine can be maintained constantly, which benefits to economize fuel consumption and also benefits to maintain a good function of braking ability.

It is further understood by those skilled in the art that the foregoing description is a preferred embodiment of the disclosed system and that various changes and modifications may be made in the invention without departing from the spirit and scope thereof.

What is claimed is:

1. A method of supplying and treating a lubricant oil in a gas service station, comprising the steps of:

extracting at least a part of the lubricant oil from the engine when an automotive vehicle visits the station for fuel;

refilling the engine with a quantity of fresh lubricant oil which is the same as the quantity of oil extracted from the engine;

purifying the extracted oil by removing impurities by impurities removal equipment and by adding required additive agents therein; and storing the purified oil in a stand for a next opportunity for oil exchange with another vehicle, wherein the exchange of the lubricant oil is performed periodically whenever fuel is supplied to the vehicle in at least two successive refuelings.

2. A method according to claim 1, wherein the impurities removal equipment comprises a centrifuge which removes impurities in size bigger than 10 $\mu$m and a filter device composed of filter elements equipped with piled thin papers, which removes impurities in size bigger than 1 $\mu$m.

3. A method according to claim 1, wherein synchronized movement for extracting oil from the engine and refilling the quantity of fresh oil into the engine is performed by an coaxial pump.

4. A method according to claim 1, wherein the extraction of the lubricant oil is performed through an oil gauge pipe.

5. A method according to claim 1, wherein an extracting pipe is connected with a drain hole in an oil pan, and the pipe is sealed with a plug until the exchange of lubricant oil is started, and wherein the pipe is also freely connected with an oil supply pipe installed in the stand.

6. A method according to claim 1, wherein engine oil pressure force conveys extracted oil into a container installed in the stand, while fresh oil is conveyed into the engine from the container.

7. A method according to claim 1, wherein said refilling occurs at a same time or after said extraction.

8. A method according to claim 1, wherein said at least part of said lubricant is more than 50% of the lubricant oil in the engine.

* * * * *